US011306547B2

(12) United States Patent
Thomas

(10) Patent No.: US 11,306,547 B2
(45) Date of Patent: Apr. 19, 2022

(54) SYSTEMS AND METHODS FOR RELEASING A TOOL STRING

(71) Applicant: Halliburton Energy Services, Inc., Houston, TX (US)

(72) Inventor: Sean Gregory Thomas, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 387 days.

(21) Appl. No.: 14/766,663

(22) PCT Filed: May 16, 2013

(86) PCT No.: PCT/US2013/041298

§ 371 (c)(1),
(2) Date: Aug. 7, 2015

(87) PCT Pub. No.: WO2014/185910

PCT Pub. Date: Nov. 20, 2014

(65) Prior Publication Data

US 2015/0376957 A1 Dec. 31, 2015

(51) Int. Cl.
*E21B 17/06* (2006.01)
*E21B 23/14* (2006.01)

(52) U.S. Cl.
CPC ..... *E21B 17/06* (2013.01); *E21B 23/14* (2013.01)

(58) Field of Classification Search
CPC ..... E21B 17/06; E21B 23/14
See application file for complete search history.

(56) References Cited

U.S. PATENT DOCUMENTS 4,477,104 A * 10/1984 Akkerman ..... E21B 17/06 166/124
4,574,892 A * 3/1986 Grigar ..... E21B 43/11855 175/4.51
4,756,363 A * 7/1988 Lanmon, II ..... E21B 17/06 166/55.1
5,462,117 A * 10/1995 Green ..... E21B 23/00 166/278
5,778,979 A * 7/1998 Burleson ..... E21B 43/116 166/297
5,810,088 A * 9/1998 Lamirand ..... E21B 23/04 166/242.6

(Continued)

FOREIGN PATENT DOCUMENTS

WO 2014185910 A1 11/2014

OTHER PUBLICATIONS

International Search Report and Written Opinion for PCT/US2013/041298 dated Feb. 25, 2014.

*Primary Examiner* — Christopher J Sebesta
*Assistant Examiner* — Neel Girish Patel
(74) *Attorney, Agent, or Firm* — McGuireWoods LLP

(57) ABSTRACT

Disclosed is a release tool used to separate portions of a tool string. One release tool includes a main body, a bolt housing coupled to the main body and defining a bore for receipt of a separation bolt therein, the separation bolt being configured to couple the bolt housing to a lower sub, and a trigger mechanism communicably coupled to the separation bolt and configured to send an electrical signal to the separation bolt whereupon the separation bolt breaks and thereby allows the lower sub to separate from the bolt housing.

18 Claims, 2 Drawing Sheets

(56) References Cited

U.S. PATENT DOCUMENTS 6,098,716 A * 8/2000 Hromas ..... E21B 17/06 166/377
6,142,237 A * 11/2000 Christmas ..... E21B 17/028 166/376
6,257,331 B1 * 7/2001 Blount ..... E21B 23/04 166/123
7,353,871 B2 * 4/2008 Hromas ..... E21B 23/04 166/297
7,373,974 B2 5/2008 Connell et al.
8,230,932 B2 7/2012 Ratcliffe et al.
10,731,431 B2 * 8/2020 Massey ..... E21B 31/1075
2002/0053434 A1 * 5/2002 Chen ..... E21B 47/12 166/297
2003/0024702 A1 * 2/2003 Gray ..... E21B 31/002 166/301
2003/0188860 A1 * 10/2003 Zimmerman ..... E21B 23/06 166/181
2005/0241824 A1 11/2005 Burris et al.
2006/0048940 A1 * 3/2006 Hromas ..... E21B 43/116 166/297
2008/0041597 A1 * 2/2008 Fisher ..... E21B 47/00 166/381
2008/0110612 A1 * 5/2008 Prinz ..... F42C 15/32 166/55.2
2009/0033516 A1 * 2/2009 Alteirac ..... E21B 47/16 340/853.2
2010/0147587 A1 * 6/2010 Henderson ..... E21B 43/117 175/2
2010/0224360 A1 * 9/2010 MacDougall ..... E21B 17/07 166/250.01
2011/0079386 A1 * 4/2011 Fripp ..... E21B 47/12 166/249
2011/0186353 A1 * 8/2011 Turner ..... G01H 1/003 175/40
2011/0308784 A1 * 12/2011 Ollerenshaw ..... E21B 17/06 166/72
2012/0097259 A1 * 4/2012 Baltimore ..... E21B 43/0122 137/15.01
2012/0285703 A1 11/2012 Abraham et al.
2012/0325463 A1 * 12/2012 Chatelet ..... F42D 1/05 166/250.01
2013/0341007 A1 * 12/2013 Umphries ..... E21B 23/08 166/244.1
2015/0345231 A1 * 12/2015 Thomas ..... E21B 17/06 166/377
2017/0130554 A1 * 5/2017 Jones ..... E21B 33/1293
2018/0258724 A1 * 9/2018 Massey ..... E21B 17/06
2019/0330947 A1 * 10/2019 Mulhern ..... E21B 23/10

* cited by examiner

SYSTEMS AND METHODS FOR RELEASING A TOOL STRING

BACKGROUND

The present disclosure is related to downhole tools used in the oil and gas industry and, in particular, to a release tool used to separate portions of a tool string.

Hydrocarbons are typically produced from wellbores drilled from the Earth's surface through a variety of producing and non-producing subterranean zones. The wellbore may be drilled substantially vertically or may be drilled as an offset well that has some amount of horizontal displacement from the surface entry point. A variety of servicing operations may be performed in the wellbore after it has been drilled and completed by lowering different kinds of downhole tools into the wellbore. For example, a tool string containing measuring instruments are commonly lowered into the wellbore to obtain various downhole measurements, such as bottom hole pressure and temperature. Various sampling devices are also commonly lowered into the wellbore in the tool string to obtain fluid samples at various target zones of the subterranean formation in order to determine the exact composition of the formation fluids of interest.

Such servicing operations are typically undertaken by lowering the tool string and its various downhole tools into the wellbore on a tension member conveyance, such as wireline or slickline. After the wellbore servicing operation is completed, the downhole tool is withdrawn from the wellbore and the slickline is re-coiled back onto an adjacent wire spool or drum. During its ascent to the surface, the tool string can sometimes become stuck due to differential sticking, key seating, hole sloughing, debris lodged in the wellbore, and other common wellbore conditions. In such situations, the tool string can oftentimes be freed through the application of ordinary tensile or compressive forces delivered from the surface.

In other situations, however, the conveyance line must be severed by introducing a cutting tool into the wellbore. This tool can be attached to the conveyance and, when it is dropped from the surface, it will slide down the conveyance until it hits a restriction or the top of the tool string. The tool will cut the conveyance at that point, thereby allowing the conveyance to be retrieved. Oftentimes the tool cannot reach the top of the tool string or otherwise prematurely cuts the conveyance upon striking a restriction in the wellbore. This will often leave a long length of conveyance remaining above the tool string that requires fishing operations that could result in considerable added expense. The fishing job could very well require coiled tubing or tubing fishing which, in addition to service costs, could result in days or weeks of lost rig time and lost production.

SUMMARY OF THE DISCLOSURE

The present disclosure is related to downhole tools used in the oil and gas industry and, in particular, to a release tool used to separate portions of a tool string.

In some embodiments, a release tool is disclosed and may include a main body, a bolt housing coupled to the main body and defining a bore for receipt of a separation bolt therein, the separation bolt being configured to couple a lower sub to the bolt housing, and a trigger mechanism communicably coupled to the separation bolt and configured to send an electrical signal to the separation bolt whereupon the separation bolt breaks and thereby allows the lower sub to separate from the bolt housing.

In other embodiments, a method of separating a tool string is disclosed. The method may include conveying the tool string into a wellbore, the tool string including a release tool having a main body coupled to a bolt housing that defines a bore configured to receive a separation bolt therein, the separation bolt being configured to couple a lower sub to the bolt housing, activating a trigger mechanism arranged within the release tool, the trigger mechanism being communicably coupled to the separation bolt, sending an electrical signal to the separation bolt with the trigger mechanism, and breaking the separation bolt upon receipt of the electrical signal and thereby freeing the lower sub from the bolt housing.

In yet other embodiments, a tool string is disclosed. The tool string may include a rope socket operatively coupled to a conveyance, a release tool coupled to the rope socket and having a main body coupled to a bolt housing that defines a bore configured to receive a separation bolt therein and a trigger mechanism communicably coupled to the separation bolt, and a lower sub coupled to the bolt housing with the separation bolt, wherein the trigger mechanism is configured to send an electrical signal to the separation bolt to detonate one or more explosive charges arranged within the separation bolt and thereby allowing the release tool to separate from the lower sub.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is related to downhole tools used in the oil and gas industry and, in particular, to a release tool used to separate portions of a tool string.

Disclosed are systems and methods of separating a tool string within a wellbore. This may prove advantageous in the event the tool string becomes stuck or otherwise unable to be retrieved to the surface during a wellbore operation. Those skilled in the art will readily appreciate, however, that the disclosed systems and methods may equally be used in cases when the tool string is not stuck but separation is nonetheless desired.

The tool string may include a release tool that has a trigger mechanism arranged therein. Upon actuation, the trigger mechanism may be configured to send an electrical signal to a separation bolt that detonates and thereby effectively allows the release tool to separate upper portions of the tool string from stuck lower portions. As least one advantage of the exemplary release tool is that there are essentially no moving parts. Rather, the separation bolt is the primary support means, and once it is activated, the release tool separates the tool string into two portions. Another advantage is that the release tool requires no manual manipulation or intervention from the surface in order to separate the tool string. Regardless of well depth, deviation or other well parameters, the separation of the tool string can occur at or near the top of the tool string, and an external fish neck will remains in the well for future fishing operations. Moreover, in the event the release tool activates within the well, it can be reused following disassembly and reassembly.

Figure 1:
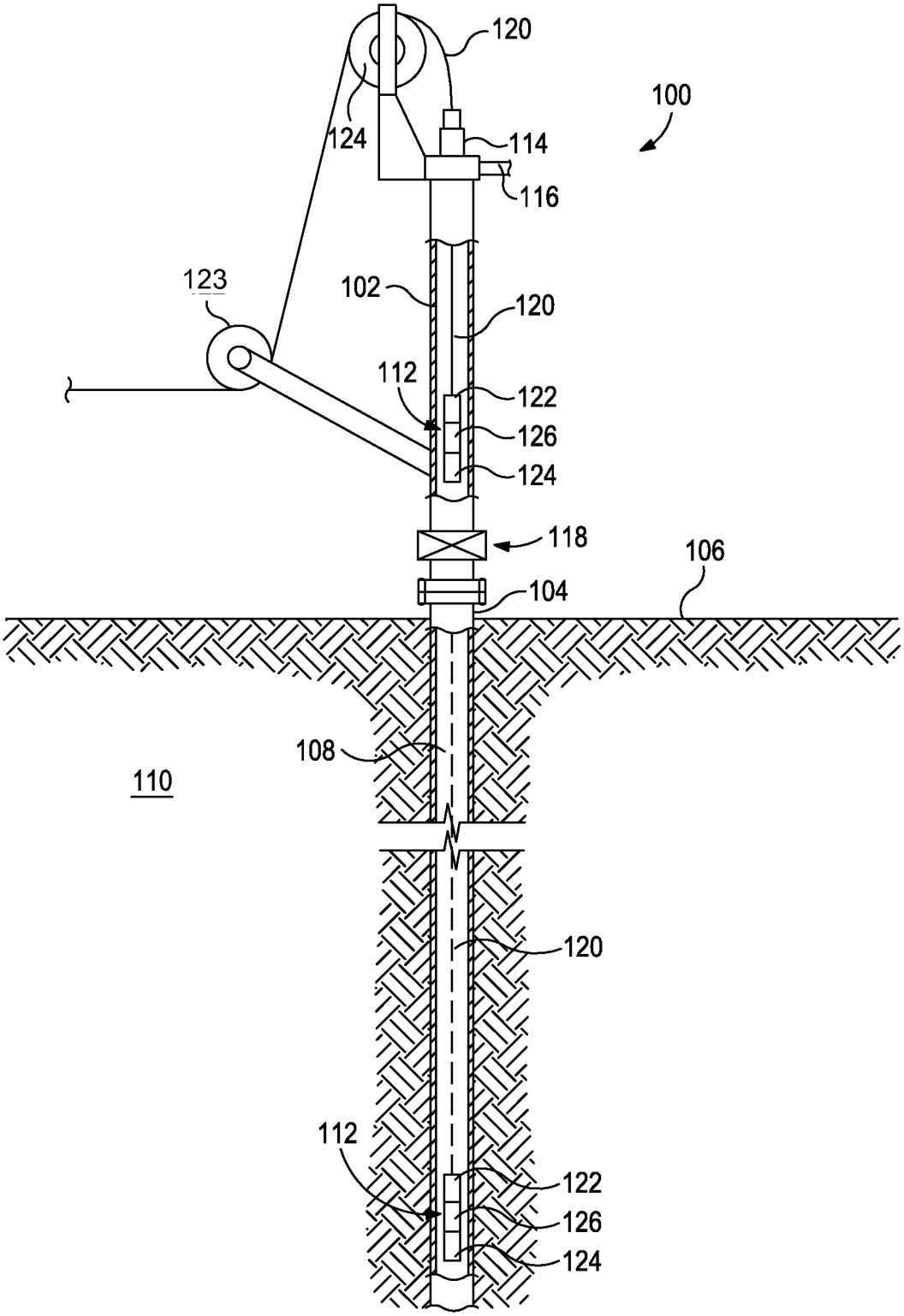
FIG. 1 is a wellbore system that embodies the principles of the present disclosure, according to one or more embodiments.

Referring to FIG. 1, illustrated is an exemplary wellbore system 100 that may embody one or more principles of the present disclosure, according to one or more embodiments. The system 100 may include a lubricator 102 operatively coupled to a wellhead 104 installed at the surface 106 of a wellbore 108. As illustrated, the wellbore 108 extends from the surface 106 and penetrates a subterranean formation 110 for the purpose of recovering hydrocarbons therefrom. While shown as extending vertically from the surface 106 in FIG. 1, it will be appreciated that the wellbore 108 may equally be deviated, horizontal, and/or curved over at least some portions of the wellbore 108, without departing from the scope of the disclosure. The wellbore 108 may be cased, open hole, contain tubing, and/or may generally be characterized as a hole in the ground having a variety of shapes and/or geometries as are known to those of skill in the art. Furthermore, it will be appreciated that embodiments disclosed herein may be employed in surface (e.g., land-based) or subsea wells, without departing from the scope of the disclosure.

The lubricator 102 may be coupled to the wellhead 104 using a variety of known techniques, such as a clamped or bolted connection. Additional components (not shown), such as a tubing head and/or adapter, may be positioned between the lubricator 102 and the wellhead 104. The lubricator 102 may be an elongate, high-pressure pipe or tubular configured to provide a means for introducing a tool string 112 into the wellbore 108 in order to undertake a variety of servicing operations within the wellbore 108. The top of the lubricator 102 may include a stuffing box 114 fluidly coupled to a high-pressure grease-injection line 116 used to introduce grease or another type of sealant into the stuffing box 114 in order to generate a seal. The lower part of the lubricator 102 may include one or more valves 118, such as an isolating valve or swab valve.

The tool string 112 may be attached to the distal end of a wellbore conveyance 120 that is extended into the lubricator 102 via the stuffing box 114. The conveyance 120 may be, but is not limited to, wireline, slickline, electric line (i.e., e-line), jointed tubing, coiled tubing, or the like. The conveyance 120 may be used to transport the tool string 112 into the wellbore 108 such that the desired wellbore servicing operations can be undertaken. The conveyance 120 is generally fed to the lubricator 102 from a spool or drum (not shown) and through one or more sheaves 123, 124 before being introduced into the stuffing box 114 which provides a seal about the conveyance 120 as it slides into the lubricator 102. Those skilled in the art will readily recognize that the arrangement and various components of the lubricator 102 and the wellhead 104 are described merely for illustrative purposes and therefore should not be considered limiting to the present disclosure. 123

The tool string 112 may include a rope socket 122, a stem 124, and a release tool 126 operatively coupled to and otherwise interposing the rope socket 122 and the stem 124. While depicted in FIG. 1 in a particular configuration, those skilled in the art will readily appreciate that the arrangement of the rope socket 122, the stem 124, and the release tool 126 in the tool string may vary, depending on the application. The rope socket 122 may be used to attach the conveyance 120 to the tool string 112, and the stem 124 may contain or otherwise include one or more downhole tools used to undertake the various wellbore servicing operations once the tool string 112 is located downhole. As described in greater detail below, the release tool 126 may include an automatic-release mechanism configured to release upper portions of the tool string 112 in the event the tool string 112 becomes stuck in the wellbore 108 or otherwise when separation is nonetheless desired without a stuck tool string 112. Upon separation, the conveyance 120 may be returned to the surface 106 as coupled to the rope socket 122 while the remaining lower portions of the tool string 112 are left downhole to be fished out later with more robust wellbore equipment.

Even though FIG. 1 depicts the tool string 112 as being extended into a substantially vertical portion of the wellbore 108, it will be appreciated by those skilled in the art that the embodiments disclosed herein are equally well suited for use in horizontal wellbores, deviated wellbores, slanted wellbores, diagonal wellbores, combinations thereof, and the like. Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Moreover, as used herein, the term "proximal" refers to that portion of the component being referred to that is closest to the wellhead, and the term "distal" refers to the portion of the component that is furthest from the wellhead.

Figure 2A:
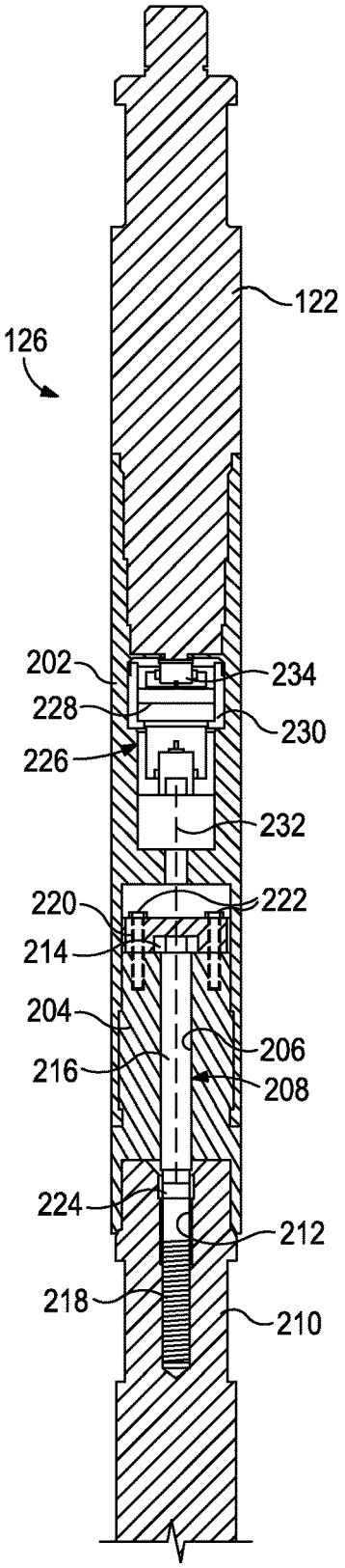
FIG. 2A illustrates a partial cross-sectional view of an exemplary release tool in a secured configuration, according to one or more embodiments.
Figure 2B:
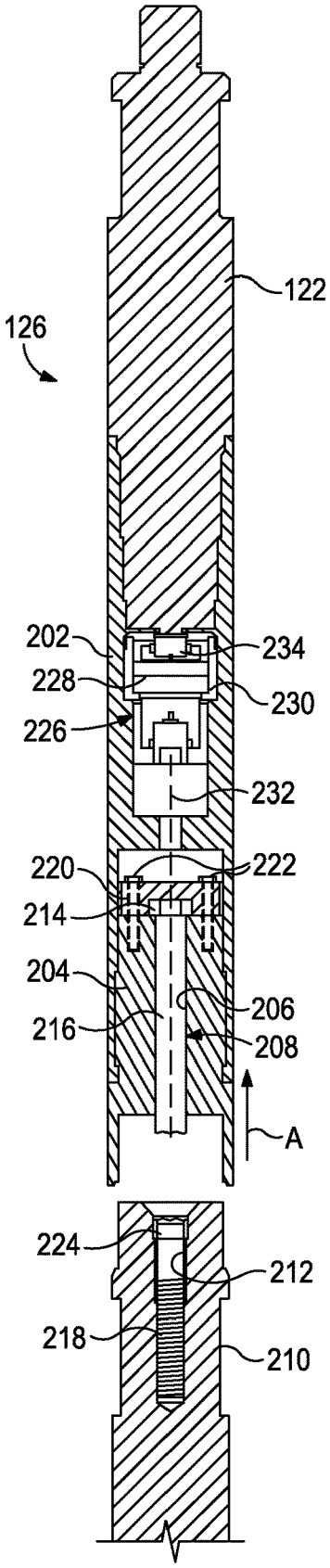
FIG. 2B illustrates a partial cross-sectional view of the release tool of FIG. 2A in a released configuration, according to one or more embodiments.

Referring now to FIGS. 2A and 2B, with continued reference to FIG. 1, illustrated are partial cross-sectional views of the release tool 126, according to one or more embodiments. In particular, FIG. 2A depicts the release tool 126 in a secured configuration and FIG. 2B depicts the release tool 126 in a released configuration. The release tool 126 may include a main body 202 coupled or otherwise attached to the rope socket 122 at its proximal end. At its distal end, the main body 202 may be coupled or otherwise attached to a bolt housing 204 that extends axially therefrom. In some embodiments, the main body 202 may be threaded to one or both of the rope socket 122 and the bolt housing 204 at its respective ends. In other embodiments, however, the main body 202 may be mechanically fastened to one or both of the rope socket 122 and the bolt housing 204 using, for example, one or more bolts, screws, shear pins, shear rings, collets, or a combination thereof.

The bolt housing 204 may define a longitudinally extending bore 206 configured to receive a separation bolt 208 therein. Among other functions described below, the separation bolt 208 may be configured to couple the bolt housing 204 to a lower sub 210 that extends axially in the downhole or distal direction from the lower end of the release tool 126. In other words, the separation bolt 208 may be configured as a primary support feature in the release tool 126. As illustrated, the lower sub 210 may also define a corresponding longitudinally-extending bore 212 configured to be arranged substantially coaxial with the bore 206 of the bolt housing 204 for the mutual receipt of the separation bolt 208.

The lower sub 210 may form part of the stem 124 of FIG. 1 and may otherwise be characterized or referred to as a lower "fish neck," as generally known to those skilled in the art. More particularly, the lower sub 210 may be referred to as an external fish neck that is capable of being attached to during fishing operations. While not shown, the lower sub 210 may facilitate coupling of the release tool 126 to the remaining lower portions of the tool string 112 (FIG. 1), including the downhole tools arranged within or forming part of the stem 124.

The separation bolt 208 may include a head 214 and a shaft 216 that extends longitudinally from the head 214. The head 214 generally exhibits a larger diameter than the shaft 216. In order to couple the lower sub 210 to the bolt housing 204, the shaft 216 may be extended through the bore 206 until the head 214 rests on the top of the bolt housing 204. The shaft 216 is simultaneously extended into the coaxial bore 212 in order to secure the lower sub 210 to the bolt housing 204. In some embodiments, as depicted, the distal end of the shaft 216 may be threaded 218 such that the separation bolt 208 may be threadably engaged with the bore 212. In other embodiments, however, the separation bolt 208 may be welded or brazed into the bore 212. In yet other embodiments, the separation bolt 208 may be adhered to the bore 212 such as by using an industrial adhesive or the like, without departing from the scope of the disclosure.

The release tool 126 may further include a separation bolt retainer 220 that may be coupled or otherwise attached to the bolt housing 204 in order to secure the separation bolt 208 against removal from the bore 206. In some embodiments, the separation bolt retainer 220 may be mechanically fastened to the bolt housing 204 using one or more mechanical fasteners 222 extended through corresponding and coaxial through holes defined in each of the separation bolt retainer 220 and the bolt housing 204. In other embodiments, however, the separation bolt retainer 220 may be secured to the bolt housing 204 via other methods including, but not limited to, welding, brazing, industrial adhesives, shearable devices, combinations thereof, and the like, without departing from the scope of the disclosure. The separation bolt retainer 220 may prove advantageous in securing the separation bolt 208 in place so that it is unable to launch itself upwards during operation, as will be described in more detail below.

The separation bolt 208 may be a pyrotechnic fastener, also known as an exploding bolt. Such bolts are manufactured for rapid structure separation by incorporating a pyrotechnic charge (not shown) that can be initiated or detonated remotely. The explosive charge(s) embedded within the separation bolt 208 may be activated or detonated by an electrical signal, as will be discussed below. Once activated, the explosive charge(s) serves to break the separation bolt 208 into two or more pieces, as shown in FIG. 2B. As illustrated in FIG. 2A, the separation bolt 208 may define or otherwise provide a score line 224 about its circumference at an intermediate location along the shaft 216. The score line 224 may indicate a generalized location where the separation bolt 208 may be severed. As will be appreciated by those skilled in the art, the score line 224 may provide a controlled release point of the separation bolt 208, such that a controlled separation of the lower sub 210 from the bolt housing 204 may occur.

The release tool 126 may further include a trigger mechanism 226 configured to send or convey the electrical signal to the separation bolt 208 in order to trigger its activation or detonation. The trigger mechanism 226 may include a power source 228 configured to power the trigger mechanism 226. The power source 228 may be one or more batteries or fuel cells, such as alkaline or lithium batteries. In other embodiments, the power source 228 may be a terminal portion of an electrical line (i.e., e-line) extending from the surface 106 (FIG. 1) or otherwise any type of device capable of providing power to trigger mechanism 226 such that it may send the electrical signal. In yet other embodiments, the power source 228 may encompass power or energy derived from a downhole power generation unit or assembly, as known to those skilled in the art.

In some embodiments, the trigger mechanism 226 may be generally arranged within a trigger housing 230 disposed within the main housing 202 of the release tool 126. As illustrated, the trigger mechanism 226 may be communicably coupled to the separation bolt 208 via one or more signal lines 232. The signal line 232 may be an electrical line or wire capable of delivering the electrical signal to the separation bolt 208.

The trigger mechanism 226 may be any device or system configured to send the electrical signal to the separation bolt 208 upon activation. In some embodiments, for example, the trigger mechanism 226 may encompass or otherwise include radio frequency (RF) technology. For instance, the trigger mechanism 226 may include an RF receiver (not shown) configured to be activated upon electromagnetic interaction with an RF transmitter (not shown) sent downhole from the surface 106 (FIG. 1). Once properly activated by the RF transmitter, the RF receiver may be configured to send the electrical signal to the separation bolt 208.

In other embodiments, the trigger mechanism 226 may be an accelerometer (not shown) or a strain gauge configured to monitor impact loads and/or tensile stress in the tool string 112 (FIG. 1) and/or in the conveyance 102 (FIG. 1). In such embodiments, the trigger mechanism 226 may be activated upon experiencing or registering a predetermined impact loading, a predetermined tensile load, or a predetermined pattern or series of jars as applied from the surface 106 (FIG. 1). Once the predetermined impact load, tensile load or pattern of jars is sensed, the trigger mechanism 226 may be configured to send the electrical signal to the separation bolt 208. As will be appreciated, in such embodiments, the trigger mechanism 226 may include various processing devices and/or systems, such as a signal processer, in order to carry out its desired operation.

In yet other embodiments, as illustrated, the trigger mechanism 226 may be a timer or timing device 234. The timer 234 may be, but is not limited to, a mechanical timer, an electro-mechanical timer, an electronic timer (e.g., digital timer), a computer timer, any combination thereof, or the like. The timer 234 may be installed in the trigger housing 230 at the surface 106 (FIG. 1) and configured or otherwise set such that it counts down from a predetermined or specified time interval at which point the timer 234 may be activated and otherwise configured to send the electrical signal to the separation bolt 208.

The predetermined time interval may be configured to span a time period within which a particular wellbore operation is to be performed. The timing for accomplishing a wellbore operation includes the time required to convey the tool string 112 into the wellbore 108 to a target location, perform the operation while at the target location, and retrieve the tool string 112 to the surface 106 following completion of the wellbore operation. If the tool string 112 becomes stuck within the wellbore 108 while performing the wellbore operation or while ascending to the surface 106, expiration of the predetermined time interval will activate the trigger mechanism 226 such that the electrical signal is sent to the separation bolt 208. As described in greater detail below, once the separation bolt 208 is detonated, the upper portions of the tool string 112 may be separated from its lower stuck portions such that the upper portions may be retrieved to the surface 106.

In some cases, for example, a particular wellbore operation may typically require around three hours to complete the assigned task. In such cases, the timer 234 may be set with a predetermined time interval of about six hours, thereby providing more than sufficient time to perform the required wellbore operation. This also provides a known time limit when the release tool 126 will be activated to separate the tool string 112 in the event the tool string 112 becomes stuck while downhole. In cases where the tool string 112 is returned to the surface 106 before the predetermined time interval is reached or otherwise spent, the release tool 126 may be disassembled and the timer 234 may be manually stopped by an operator. In other embodiments, the timer 234 may be automatically or otherwise autonomously stopped upon nearing the surface 106, such as through the use of RF technology or the like.

As will be appreciated, the predetermined time interval may vary depending on the application and the particular wellbore operation or operations that are to be undertaken while the tool string 112 is downhole. Accordingly, the timer 234 may be set with any predetermined time interval required to successfully accomplish the task at hand. In some embodiments, for example, the predetermined time interval may be set at three hours, six hours, twelve hours, twenty-four hours, or forty-eight hours. In other embodiments, the predetermined time interval may be set at any time before or after three hours and forty-eight hours or any time falling therebetween.

With continued reference to FIGS. 2A-2B and FIG. 1, exemplary operation of the release tool 126 is now provided. As the tool string 112 is conveyed downhole, the release tool 126 may be secured or otherwise coupled to the stem 124 via the lower sub 210, as generally described above. More particularly, the separation bolt 208 may be configured to couple the release tool 126 to the lower sub 210. In other embodiments, however, as also mentioned above, the general configuration and arrangement of the release tool 126 with respect to the stem 124 may vary, depending on the application. Accordingly, the embodiment shown in FIGS. 2A-2B and FIG. 1 should not be considered as limiting to the scope of the disclosure and the novel separation capabilities of the release tool 126.

In the event the tool string 112 becomes stuck while downhole, or otherwise in the event a separation of the tool string 112 is nonetheless desired, the trigger mechanism 226 may be activated. Activating the trigger mechanism 226 may result in the electrical signal being sent to the separation bolt 208 which causes the separation bolt 208 to detonate and thereby effectively separate the release tool 126 from the lower sub 210. Depending on the type of trigger mechanism 226 being used in the release tool 126, the electrical signal may be sent to the separation bolt 208 via the signal line 232 following several different scenarios briefly discussed above. Such scenarios may include sending an RF transmitter downhole to interact with an RF receiver associated with the trigger mechanism 226, and monitoring predetermined tensile loads or predetermined patterns or series of jars as applied from the surface 106 with an accelerometer or a strain gauge associated with the trigger mechanism 226.

In other embodiments, the trigger mechanism 226 may include the timer 234 which may transmit the electrical signal upon expiration of a predetermined time interval programmed into the timer 234 before the tool string 112 is introduced into the wellbore 108. In some embodiments, the timer 234 may be activated or "turned on" while at the surface 106. In other embodiments, the timer 234 may be activated at another location within the wellbore 108. For instance, in at least one embodiment, the timer 234 may be activated by sending another activating device (e.g., RF technology) downhole to interact with the timer 234 once the tool string 112 becomes stuck. In such embodiments, the predetermined time interval may be quite short, such as a few minutes or even instantaneous.

Referring specifically to FIG. 2B, upon receiving the electrical signal via the signal line 232, the separation bolt 208 may be configured to detonate and break generally at or near the score line 224. Severing the separation bolt 208 then allows the release tool 126 to be separated from the lower sub 210 by pulling up on the tool string 112 in the direction A whereby the rope socket 122 and the release tool 126 ascend while the lower sub 210 and the remaining portions of the stem 124 remain in the wellbore 108. Once at the surface 106, the release tool 126 may be disassembled, reset, and used again in another wellbore operation.

Importantly, the lower sub 210 left behind in the wellbore 108 provides an exposed external fish neck (i.e., an outer diameter locating profile) that may be grasped onto later using more robust wellbore fishing equipment. The fishing equipment may be configured to locate the external fish neck in order to remove the remaining lower portions of the tool string 112 from their stuck configuration.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A release tool, comprising:

a main body surrounding a separation bolt retainer and at least partially surrounding a bolt housing;

a separation bolt configured with at least one explosive charge;

the bolt housing coupled to the main body and defining a bore for receipt of the separation bolt therein, the separation bolt being configured to couple a lower sub to a bottom end of the bolt housing;

the separation bolt retainer having one or more mechanical fasteners coupled to the bolt housing and configured to secure the separation bolt against removal from the bore and launching itself upwards during operation; and an electrically responsive trigger mechanism electrically coupled to the separation bolt and configured to send a signal to the separation bolt whereupon the separation bolt is severed into a first segment and a second segment and thereby allows the lower sub to separate from the bolt housing, wherein the separation bolt is a pyrotechnic fastener having one or more explosive charges arranged therein and configured to detonate upon receipt of the signal, wherein the separation bolt comprises a score line about a circumference of the separation bolt at an intermediate location along a length of the separation bolt indicating a location where the separation bolt severs in response to the detonation of the at least one charge to provide a controlled release point between the first and second segments and allow subsequent use of at least the second segment of the separation bolt in the lower sub;

wherein the bore is a first bore and the lower sub defines a second bore configured to be arranged coaxial with the first bore for mutual receipt of the separation bolt.

2. The release tool of claim 1, wherein the trigger mechanism is a timer configured to send the signal upon expiration of a predetermined time interval.

3. The release tool of claim 2, wherein the predetermined time interval spans a time greater than conveying a tool string having attached thereto the release tool into a wellbore to a target location, performing a particular wellbore operation, and retrieving the tool string to a surface.

4. The release tool of claim 1, wherein the trigger mechanism comprises a radio frequency receiver configured to send the signal to the separation bolt upon electromagnetic interaction with a radio frequency transmitter, the radio frequency transmitter sent downhole from a surface.

5. The release tool of claim 1, wherein the trigger mechanism comprises an accelerometer configured to monitor impact loads, the trigger mechanism further configured to send the signal to the separation bolt upon registering at least one selected from a group consisting of a predetermined impact load and a predetermined pattern or series of jars in a tool string.

6. The release tool of claim 1, wherein the trigger mechanism comprises at least one of an accelerometer configured to monitor impact loads and a strain gauge configured to monitor tensile stress, the trigger mechanism further configured to send the signal to the separation bolt upon registering at least one selected from a group consisting of a predetermined impact load and a predetermined pattern or series of jars in a conveyance.

7. The release tool of claim 1, wherein the trigger mechanism comprises an accelerometer configured to monitor impact loads, the trigger mechanism further configured to send the signal to the separation bolt upon registering at least one selected from a group consisting of a predetermined impact load and a predetermined pattern or series of jars in a conveyance.

8. A method of separating a tool string, comprising:

securing a separation bolt against removal from a bore with a separation bolt retainer coupled to a bolt housing, the separation bolt retainer having one or more mechanical fasteners that couples the separation bolt retainer to the bolt housing and secures the separation bolt against removal from the bore and launching itself upwards during operation;

conveying the tool string into a wellbore, the tool string including a release tool having a main body surrounding the separation bolt retainer and at least partially surrounding the bolt housing and coupled to the bolt housing, the bolt housing defines the bore configured to receive a separation bolt therein, the separation bolt being configured with at least one explosive charge;

activating an electrically responsive trigger mechanism arranged within the release tool, the trigger mechanism being electrically coupled to the separation bolt;

sending a signal to the separation bolt with the trigger mechanism; and breaking the separation bolt into a first segment and a second segment upon receipt of the signal and thereby freeing a lower sub from a bottom end of the bolt housing, wherein the separation bolt is a pyrotechnic fastener having one or more explosive charges arranged therein and breaking the separation bolt comprises detonating the one or more explosive charges upon receipt of the signal, wherein the separation bolt comprises a score line about a circumference of the separation bolt at an intermediate location along a length of the separation bolt indicating a location where the separation bolt severs in response to the detonation of the at least one charge to provide a controlled release point between the first and second segments and allow subsequent use of at least the second segment of the separation bolt in the lower sub;

wherein the bore is a first bore and the lower sub defines a second bore configured to be arranged coaxial with the first bore for mutual receipt of the separation bolt.

9. The method of claim 8, wherein the trigger mechanism is a timer and activating the trigger mechanism comprises:

setting the timer with a predetermined time interval; and allowing the predetermined time interval to expire.

10. The method of claim 9, wherein conveying the tool string into the wellbore is preceded by setting the timer with the predetermined time interval; wherein the predetermined time interval spans a time greater than conveying a tool string having attached thereto a release tool into a wellbore to a target location, performing a particular wellbore operation, and retrieving the tool string to a surface.

11. The method of claim 8, wherein the trigger mechanism comprises a radio frequency receiver and activating the trigger mechanism comprises:

sending a radio frequency transmitter downhole; and electromagnetically interacting the radio frequency transmitter with the radio frequency receiver.

12. The method of claim 8, wherein the trigger mechanism comprises an accelerometer and activating the trigger mechanism comprises:

monitoring impact loads in the tool string with the accelerometer; and sending the signal upon registering a predetermined impact load or a predetermined pattern or series of jars in the tool string.

13. The method of claim 8, wherein the trigger mechanism comprises an accelerometer and activating the trigger mechanism comprises:

monitoring impact loads in the tool string with the accelerometer; and sending the signal upon registering a predetermined impact load or a predetermined pattern or series of jars in a conveyance.

14. A tool string, comprising:

a rope socket operatively coupled to a conveyance;

a release tool coupled to the rope socket and having a main body surrounding a separation bolt retainer, at least partially surrounding a bolt housing, and coupled to the bolt housing, the bolt housing defines a bore configured to receive a separation bolt therein and an electrically responsive trigger mechanism electrically coupled to the separation bolt;

the separation bolt retainer having one or more mechanical fasteners coupled to the bolt housing and configured to secure the separation bolt against removal from the bore and launching itself upwards during operation; and a lower sub coupled to a bottom end of the bolt housing with the separation bolt, wherein the trigger mechanism is configured to send a signal to the separation bolt to detonate one or more explosive charges arranged within the separation bolt and thereby allowing the release tool to separate from the lower sub, wherein the separation bolt is a pyrotechnic fastener having one or more explosive charges arranged therein and breaking the separation bolt comprises detonating the one or more explosive charges upon receipt of the signal, wherein the separation bolt comprises a score line about a circumference of the separation bolt at an intermediate location along a length of the separation bolt indicating a location where the separation bolt severs into first and second segments in response to the detonation of the at least one charge, wherein the separation bolt is severed at the score line to provide a controlled release point between the first and second segments and allow subsequent use of at least the second segment of the separation bolt in the lower sub;

wherein the separation bolt is configured with at least one explosive charge;

wherein the bore is a first bore and the lower sub defines a second bore configured to be arranged coaxial with the first bore for mutual receipt of the separation bolt.

15. The tool string of claim 14, wherein the trigger mechanism is a timer configured to send the signal upon expiration of a predetermined time interval.

16. The tool string of claim 15, wherein the predetermined time interval spans a time greater than conveying the tool string into a wellbore to a target location, performing a particular wellbore operation, and retrieving the tool string to a surface.

17. The tool string of claim 14, wherein the trigger mechanism comprises a radio frequency receiver configured to be activated to send the signal upon electromagnetic interaction with a radio frequency transmitter, the radio frequency transmitter sent downhole from a surface.

18. The tool string of claim 14, wherein the trigger mechanism comprises an accelerometer configured to monitor impact loads, the trigger mechanism further configured to send the signal to the separation bolt upon registering at least one selected from a group consisting of a predetermined impact load and a predetermined pattern or series of jars in the tool string.

* * * * *